United States Patent [19]

Thinesen et al.

[11] Patent Number: 4,847,820

[45] Date of Patent: Jul. 11, 1989

[54] WATCH ATTACHMENT

[75] Inventors: Tom Thinesen, Sunnyvale, Calif.; John Houlihan, Watertown; Judith Reichel, Southbury, both of Conn.; Fred Olsen, Oslo, Norway

[73] Assignee: Timex Corporation, Waterbury, Conn.

[21] Appl. No.: 258,958

[22] Filed: Oct. 17, 1988

[51] Int. Cl.[4] ..... G04B 37/00; A44C 5/00

[52] U.S. Cl. ..... 368/282; 224/164; 224/180

[58] Field of Search ..... 368/281–282; 224/164–179

[56] References Cited

U.S. PATENT DOCUMENTS 1,093,757 4/1914 Becken ..... 224/164
2,226,128 12/1940 Prestinari ..... 368/281
2,280,490 4/1942 Keltie ..... 224/164

*Primary Examiner*—Vit W. Miska
*Attorney, Agent, or Firm*—William C. Crutcher

[57] ABSTRACT

A watch case has attachment lugs on opposite ends thereof, a flexible resilient watch band with attachment ends, first means pivotably connecting one attachment end of the watch band to the lugs on the six o'clock end of the watch case, and second means pivotably connecting the other attachment end of the watch band to the lugs on the twelve o'clock end of the watch case and having abutment means limiting pivoting on the twelve o'clock lugs so as to require more resilient flexing of the watch band on the twelve o'clock end than on the six o'clock end as the band curves toward the wearer's wrist, whereby tendency of the more flexed end to unflex displaces the watch case in a preferred direction on the wrist.

8 Claims, 3 Drawing Sheets

WATCH ATTACHMENT

BACKGROUND OF THE INVENTION

This invention relates to an improved wristwatch which is designed to prevent it from moving and rotating on the wearer's wrist in a direction which makes it difficult to read the time display. More particularly the invention relates to an improved attachment for a resilient flexible watch band to a wristwatch case which will cause it to move in a preferential direction on the wearer's wrist.

The tendency of a wristwatch to move or rotate on the wearer's wrist toward the 12 o'clock position is well-known. Various suggestions are documented in the prior art for overcoming this problem. For example, U.S. Pat. No. 2,226,138—Prestinari issued Dec. 24, 1940 suggests a watch case curved to conform to the curve of the wrist.

U.S. Pat. No. 1,093,757—Becken dated Apr. 21, 1914 employs a spring secured to the strap in the form of a hook to retain the strap in the proper position on the wrist.

U.S. Pat. No. 2,280,490—Keltie dated Apr. 21, 1942 inserts a length of resilient or semi-rigid material in a portion of the strap adjacent the strap ends to stiffen the strap on one side or on both sides of the watch case. The strap ends are freely pivotable about each of one of the pivot points where the ends are attached to the watch case lugs.

The human wrist has a complex shape, the theoretical reasons for which are documented in the Prestinari patent referred to above. The tendency of a watch case to move toward the 12 o'clock position is more pronounced when the watch case is larger and flat on the bottom. This movement makes it difficult to read the time displayed by the hands or digits without twisting the wrist to an awkward position. Furthermore, movement of the wristwatch case may cause chaffing or aggravation of pronounced bone structure.

Accordingly, one object of the present invention is to provide an improved wristwatch with watch case and watch band which will tend to stay in the proper position on the wearer's wrist.

Another object of the invention is to provide an improved wristwatch case and attachment for a flexible resilient watch band which will resist its tendency to rotate on the wrist toward the 12 o'clock position, and provide a perferential tendency to rotate toward the 6 o'clock position.

DRAWING

The invention, both as to organization and method of practice, together with further objects and advantages thereof, will best be understood by reference to the following description, taken in connection with the accompanying drawings in which:

FIG. 1 is a side view of a prior art wristwatch case and watch band on a wearer's wrist, the latter shown in cross-section, FIG. 2 is a similar view of a watch case and watch band in accordance with the present invention, FIG. 3 is an enlarged fragmentary side view in cross-section showing the point of attachment of the watch band to watch case in a preferred embodiment, FIG. 3*a* is a modification of FIG. 3, and FIG. 4, FIG. 5, and FIG. 6 are views similar to FIG. 3 showing modified forms of the invention.

SUMMARY OF THE INVENTION

Briefly stated, the invention is practiced by providing a watch case with attachment lugs on opposite sides thereof, a flexible resilient watch band with attachment ends, first means pivotably connecting one attachment end of the watch band to the lugs on the six o'clock end of the watch case, and second means pivotably connecting the other attachment end of the watch band to the lugs on the twelve o'clock end of the watch case at least one strap end having abutment means limiting pivoting on said lugs so as to require greater resilient flexing of the watch band on the twelve o'clock end than on the six o'clock end as the strap curves toward the wearer's wrist, whereby tendency of the more greatly flexed end to unflex displaces the watch case in the proper direction on the wrist.

DESCRIPTION OF THE PREFERRED EMBODIMENT

Figure 1:
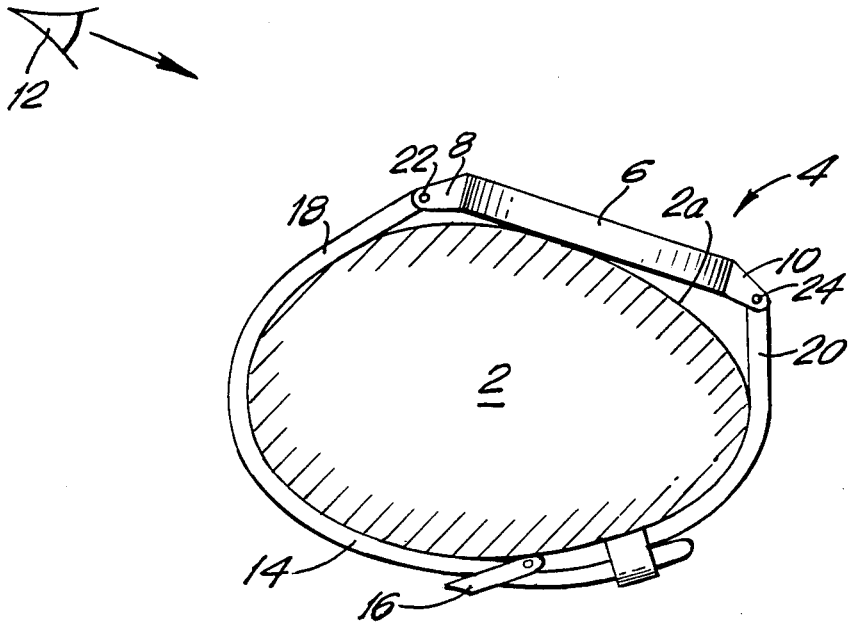
PRIOR ART FIG. 1

Referring to the prior art drawing in FIG. 1, the cross-section of a human wrist is depicted at 2. A prior art wristwatch, shown generally as 4 includes a watch case 6 with a first pair of conventional spaced attachment lugs 8 on the "six o'clock" end of watch case 6 and a second pair of spaced attachment lugs 10 on the "twelve o'clock" end of the watch case when it is viewed from a location indicated by reference numeral 12. The terms "twelve o'clock" and "six o'clock" are used herein because of conventional nomenclature employed in the watch industry by reference to a dial having numerals used in conjunction with analog watch hands. However, the terms are intended herein to also encompass the "top" and "bottom" end of a watch case which has a digital display.

Watch case 6 is held on wrist 2 by means of a watch band 14, which is shown here as comprising two separate sections connected by a buckle 16, although the invention is not limited to a two-piece watch band. Watch band 14 has a first attachment end 18 and a second attachment end 20 which are repsectively pivotably connected between first and second pairs of attachment lugs 8 and 10 by means of pins or spring bars 22, 24 extending through the watch band ends between each pair of lugs. Watch band 14 is flexible so that it will curve around wrist 2 and is also resilient to an extent depending upon the material. By flexible resilient watch band, it is intended to include herein watch bands of solid or laminated plastic material, rubber solid or multiple ply leather straps, or metal bands of mesh or of interconnected links of any type which tend to resist flexing along all or part of the their length, particularly near the ends thereof.

As shown in FIG. 1, the watch case 6 tends to gravitate toward the twelve o'clock position toward a flatter portion of the wrist, illustrated by reference numeral 2*a*, making it difficult to read from location 12 and requiring the wearer to twist the wrist inward to an awkward position for better viewing.

Figure 2:
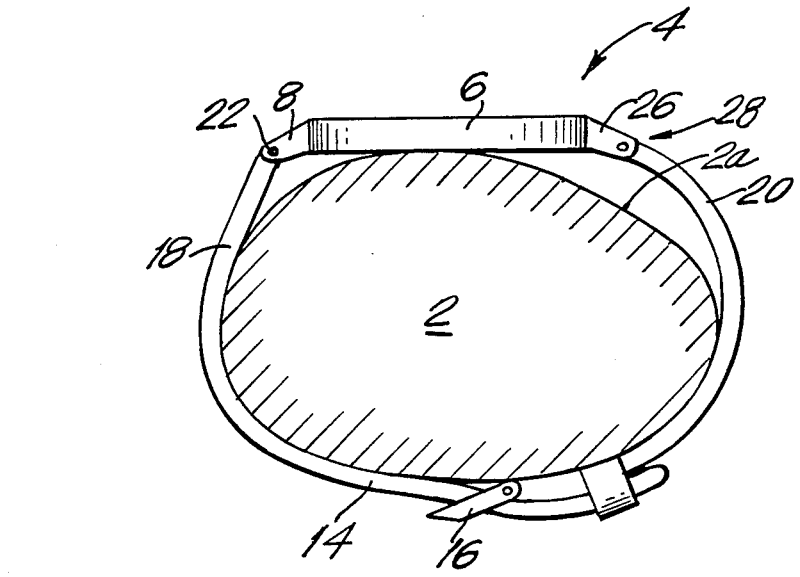

Reference to FIG. 2 of the drawing illustrates the improved watchband. The reference numerals illustrated for watch case 6, with lugs 8 and pivotable connection 22, watch band 14 with buckle 16, and attachment ends 18, 20 are in accordance with the prior art. However, in accordance with the present invention, the lugs on the twelve o'clock end, designated by reference numeral 26, and the point of attachment of the watch band, designated by reference numeral 28, have been modified by abutment means limiting pivoting on said lugs so as to require strap end 20 to flex rather than forming a freely pivotable connection.

Figure 3:
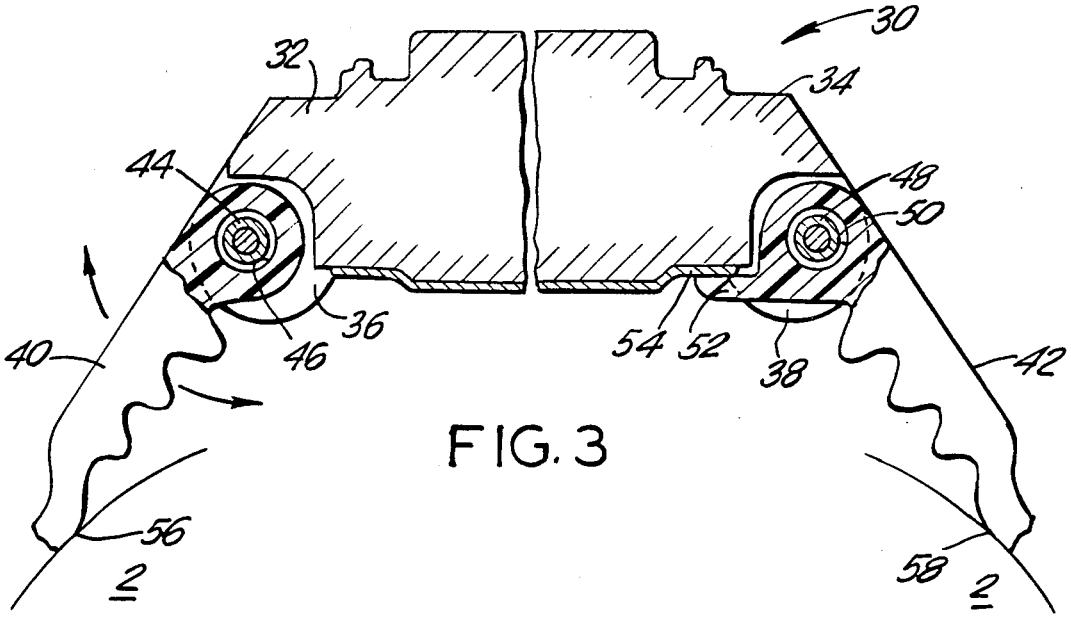

Reference to FIG. 3 of the drawing, illustrates a preferred embodiment of the invention. A watch case 30 includes a "six o'clock" end 32 and a "twelve o'clock" end 34. The watch case 30 has a pair of spaced first attachment lugs, one of which is seen at 36 on the six o'clock end and a pair of second attachment lugs, one of which is seen at 38 on the "twelve o'clock" end. A resilient flexible watch band of solid molded plastic material terminates in first attachment end 40 and a second attachment end 42. The first attachment end is pivotably connected to lugs 36 by means of a conventional spring bar 44 passing through a transverse hole 46 in the strap end, so as to be freely pivotable on lugs 36. On the "twelve o'clock" end a similar spring bar 48 passes through a hole 50 in the strap end 42 in a manner which, but for a modification, would otherwise permit free pivoting. However, in accordance with the present invention, a transverse lip 52 in integrally molded onto the strap end 42 and is designed to extend beneath a lower edge 54 of watch case 30. The lip 52 provides abutment means which cooperates with edge 54 of the case to limit pivoting toward the wrist and to require resilient flexing of the second attachment end 42 in a direction toward the wearer's wrist when the wristwatch is worn. The point of contact of the first attachment end with the wrist 2 is indicated by reference numeral 56 and the point of contact of the second attachment end 42 with wrist 2 is indicated at reference numeral 58. Because the watch band attachment end 40 is freely pivotable on the "six o'clock" end, it is not required to flex between the watch case and the wrist. The tendency of the second attachment end 42 to unflex will tend to move the watch case 30 toward the left in FIG. 3, so that it assumes the position shown in FIG. 2 of the drawing.

Figure 4:
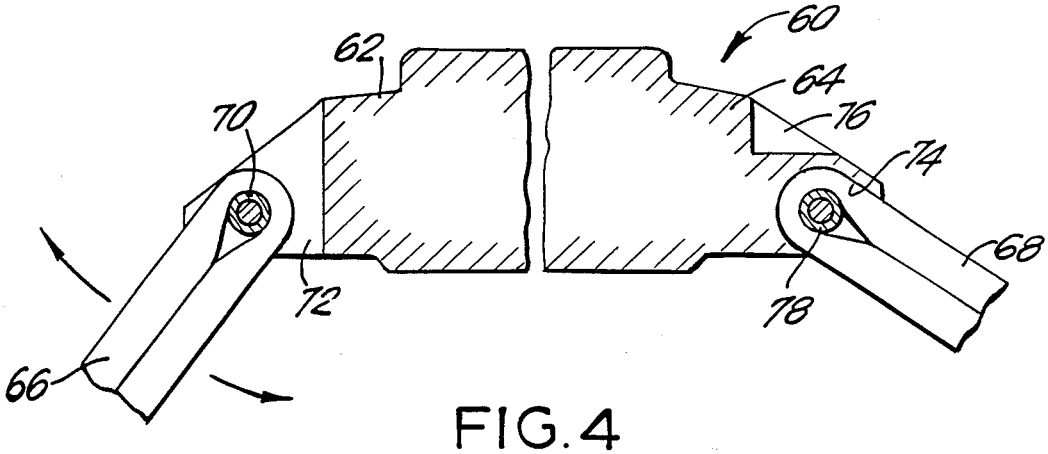

The watch case and watch band may be modified in various ways to achieve the benefits of the invention without departing from the scope of the invention. In FIG. 4, a watch case 60 has a six o'clock end 62 and twelve o'clock end 64. A two-ply resilient leather strap is shown with a first attachment end 66 and a second attachment end 68. A conventional spring bar 70 forms a freely pivotable connection on the six o'clock end between conventional lugs 72. However, on the twelve o'clock end, a sheath or pocket 74 is provided extending laterally between part or all of the distance between lugs 76. The pocket is sized to snugly fit the exterior of strap 68 when it is attached by spring bar 78. The strap end 68 forms abutment means which cooperates with the pocket 74 to limit pivoting in either direction about pin 78 and to require flexing of the attachment end 68 in either direction.

Although the FIG. 3 and FIG. 4 versions have freely pivotable connections on the six o'clock end of the case, and therefore cause no flexing of that end of the watch band, the inventive concept also applies to watch bands wherein the watch band on the twelve o'clock end is resiliently caused to flex to a greater extent that the six o'clock end.

Figure 3A:
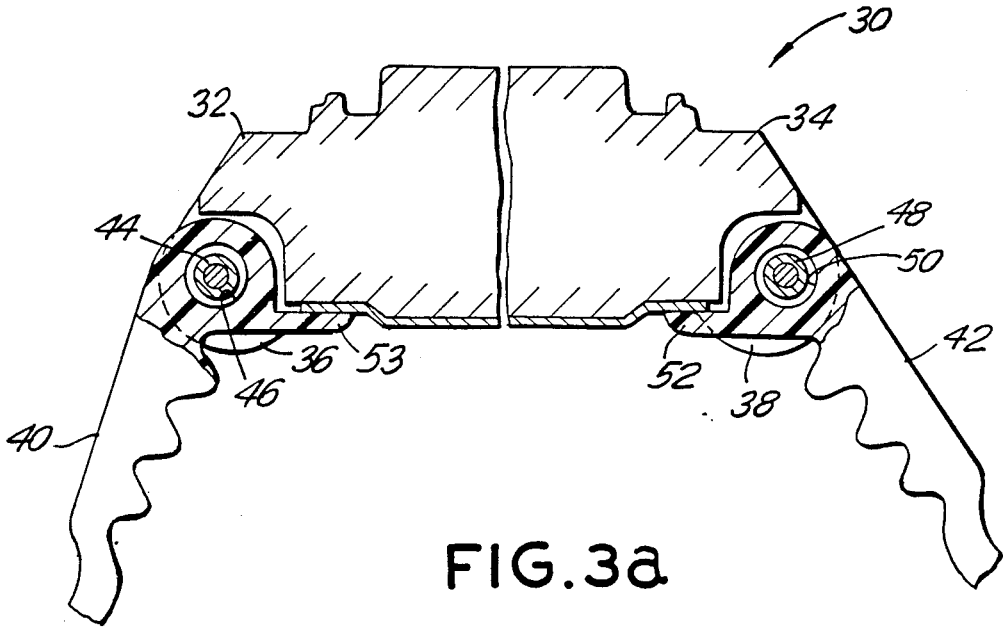

The FIG. 3 arrangement may be modified as shown in FIG. 3*a* to required flexing of the left hand strap end 40 by adding further abutment means comprising a transverse lip 53 on the left hand (six o'clock) strap end 40. This is identical to the lip 52 on the right hand side, except that it is positioned to allow the strap end 40 to pivot toward the wrist to a greater extend than the strap end 42. This requires greater flexing of the watch band on the twelve o'clock end than on the six o'clock end.

Figure 5:
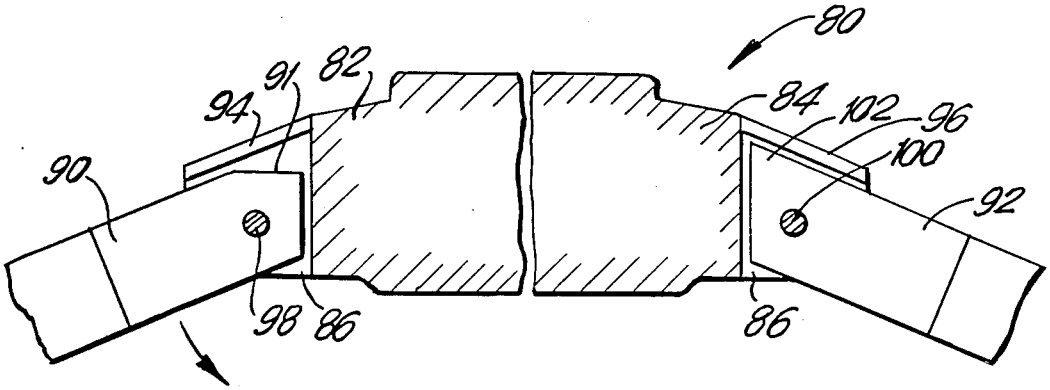

Reference to FIG. 5 of the drawing shows a modification for a watch case 80 with six o'clock end 82 and twelve o'clock end 84, attachment lugs 86, 88 and first and second attachment ends 90, 92 respectively of a flexible resilient metal watch band. Watch case 80 includes bezel extensions 94, 96 which give a "fitted" appearance. Strap end 90 provides free pivoting about a pin 98 until first abutment means comprising an extension 91 strikes the underside of bezel extension 94. Thereafter flexing is required of the first attachment end. The second attachment end 92, which would otherwise be pivotable about a pin 100 has been provided with spaced abutment means comprising an extension 102 which abuts and cooperates with bezel extension 96 to limit pivoting so as to always require flexing of the second attachment end 92 toward the wrist. The operation of FIG. 5 is as described previously, except that free pivoting is permitted of the first attachment end before flexing is required. This causes preferential movement toward the six o'clock position as before, since the arrangement requires greater resilient flexing of the watch band on the twelve o'clock end than on the six o'clock end.

Figure 6:
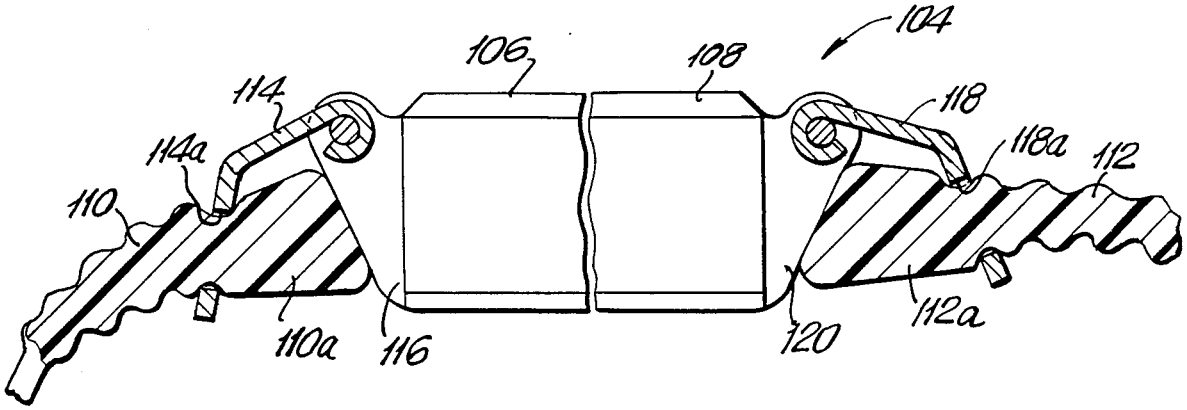

FIG. 6 shows a shackle-type attachment for a watch case 104 with a six o'clock end 106 and twelve o'clock end 108. A removable molded rubber strap has a first attachment end 110 and second attachment end 112. A pivotable metal shackle 114 is hinged to an angled end 116 of the case. A similar metal shackle 118 is hinged to an opposite angled case end 120. The hinges provided by the angled case ends and shackles are equivalent to lugs, except that the shackles straddle the case end, rather than fitting between spaced lugs, and are included in the definition of pivotable connections. The strap end 110, passes through an opening 114*a* in the shackle 114 and terminates in an enlarged molded protuberance 110*a*. Similarly, strap end 112 passes through an opening 118*a* in the shackle and terminates in protuberance 112*a*. Protuberance 110*a* and 112*a* are first and second abutment means which contact the watch case ends 116 and 120 respectively to limit pivoting of the shackles and strap ends toward the wrist.

The length and shape of the protuberance 112*a* is longer and bulkier than that of 110*a* and is selected to cause strap end 112 to require more flexing than strap end 110 in order to curve to the wrist. This apparent greater stiffness on the twelve o'clock side causes the watch case 104 to preferentially move toward the six o'clock position.

Other modification will be apparent to those skilled in the art and it is desired to include in the appended claims all such modifications as fall within the true spirit and scope of the invention.

We claim:

1. An improved wristwatch comprising:

a watch case having first lugs on a "six o'clock" end thereof and second lugs on a "twelve o'clock" end thereof, a flexible resilient watch band adapted to flex and curve about a wearer's wrist, said watch band having first and second attachment ends, first means pivotably connecting said first attachment end to said first lugs, and second means pivotably connecting said second attachment end to said second lugs, said second attachment end having abutment means limiting pivoting on said second lugs, so as to require greater resilient flexing of said second attachment end in a direction toward said wearer's wrist on the twelve o'clock end than on the six o'clock end when the wristwatch is worn, whereby tendency of said second attachment end to unflex displaces the watch case on said wearer's wrist toward the six o'clock end thereof.

2. The combination according to claim 1, wherein said abutment means comprises an extending portion on said second attachment end adapted to abut a portion of said watch case so as to limit pivoting of said second attachment end and require flexing in a direction toward the wearer's wrist.

3. The combination according to claim 1, including first and second abutment means on said first and second attachment ends respectively and adapted to abut opposed portions of said watch case and arranged to require greater flexing on said twelve o'clock end than on said six o'clock end.

4. The combination according to claim 3, including first and second extending portions on said watch case cooperating with said first and second abutment means to require greater flexing toward the wearer's wrist on the twelve o'clock end of said watch case.

5. The combination according to claim 1, wherein said watch case includes a pocket receiving a portion of said second attachment end, said second attachment end comprising abutment means fitting within said pocket to require flexing of said second attachment end.

6. The combination according to claim 1, wherein said first means permits pivoting without substantial flexing of said first attachment end.

7. The combination according to claim 1, wherein said first attachment end defines further abutment means limiting pivoting on said first lugs and causing resilient flexing of said first attachment end to a lesser extent than said second attachment end, whereby unflexing of said strap causes preferential movement toward the six o'clock end of the watch case.

8. The combination according to claim 1, wherein said flexible resilient watch band has first and second sections adapted to be connected by a buckle or clasp, and wherein the material of said watch band is selected from a group consisting of molded solid plastic, laminated plastic, rubber, solid leather, leather ply, metal mesh, or interconnected metal links.

* * * * *